US009460610B2

(12) United States Patent
Okeefe et al.

(10) Patent No.: US 9,460,610 B2
(45) **Date of Patent: *Oct. 4, 2016**

(54) BRIDGE BETWEEN SECURITY SYSTEM AND APPLIANCES

(71) Applicant: Honeywell International, Inc., Morristown, NJ (US)

(72) Inventors: Mark Douglas Okeefe, San Diego, CA (US); Matt S. Kruger, San Diego, CA (US); Alfred M. Lizza, Oyster Bay, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 118 days.

This patent is subject to a terminal disclaimer.

(21) Appl. No.: 14/487,470

(22) Filed: Sep. 16, 2014

(65) Prior Publication Data

US 2015/0002289 A1 Jan. 1, 2015

Related U.S. Application Data

(63) Continuation of application No. 12/950,075, filed on Nov. 19, 2010, now Pat. No. 8,872,625.

(51) Int. Cl.

| | |
|---|---|
| ***G08B 25/00*** | (2006.01) |
| ***G08B 25/14*** | (2006.01) |
| ***G08B 29/16*** | (2006.01) |
| ***G08C 17/02*** | (2006.01) |

(52) U.S. Cl.

CPC ..... *G08B 25/008* (2013.01); *G08B 25/14* (2013.01); *G08B 29/16* (2013.01); *G08C 17/02* (2013.01); *Y10T 307/766* (2015.04)

(58) Field of Classification Search

CPC .... G08B 25/008; G08B 25/14; G08B 29/16; G08C 17/02; Y10T 307/766

USPC ..... 340/501

See application file for complete search history.

(56) References Cited

U.S. PATENT DOCUMENTS

| | | | | |
|---|---|---|---|---|
| 5,801,625 | A | 9/1998 | Wang | |
| 2004/0075347 | A1 | 4/2004 | Biskup et al. | |
| 2004/0172396 | A1 * | 9/2004 | Vanska ..... | G07C 9/00309 |

(Continued)

FOREIGN PATENT DOCUMENTS

| | | | |
|---|---|---|---|
| EP | 0 492 427 | A2 | 7/1992 |
| EP | 0 492 427 | A3 | 6/1993 |
| WO | WO 97/44737 | A1 | 11/1997 |

OTHER PUBLICATIONS

European Search Report from corresponding patent application EP11190024.7, dated Mar. 16, 2012.

*Primary Examiner* — Omer S Khan

(74) *Attorney, Agent, or Firm* — Husch Blackwell LLP

(57) ABSTRACT

A system and method for controlling an appliance are provided. The system includes a plurality of sensing devices and a plurality of appliance control devices. The sensing devices are locatable in a selected area with each device wirelessly transmitting a first status message and a second status message. Each of the plurality of appliance control devices has a wireless receiver that continuously monitors a transmission spectrum for wireless status messages, has a decryption device that decrypts any received encrypted messages, provides an ON and OFF output, and provides one of the ON and OFF outputs upon receiving a first status message and the other of the ON and OFF outputs upon receiving a second status message.

14 Claims, 1 Drawing Sheet

(56) References Cited

U.S. PATENT DOCUMENTS

2005/0270151 A1* 12/2005 Winick ..... F24F 11/0086 340/539.1

2009/0266904 A1* 10/2009 Cohen ..... F24F 11/001 236/51

2010/0283579 A1* 11/2010 Kraus ..... G07C 9/00944 340/5.7

* cited by examiner

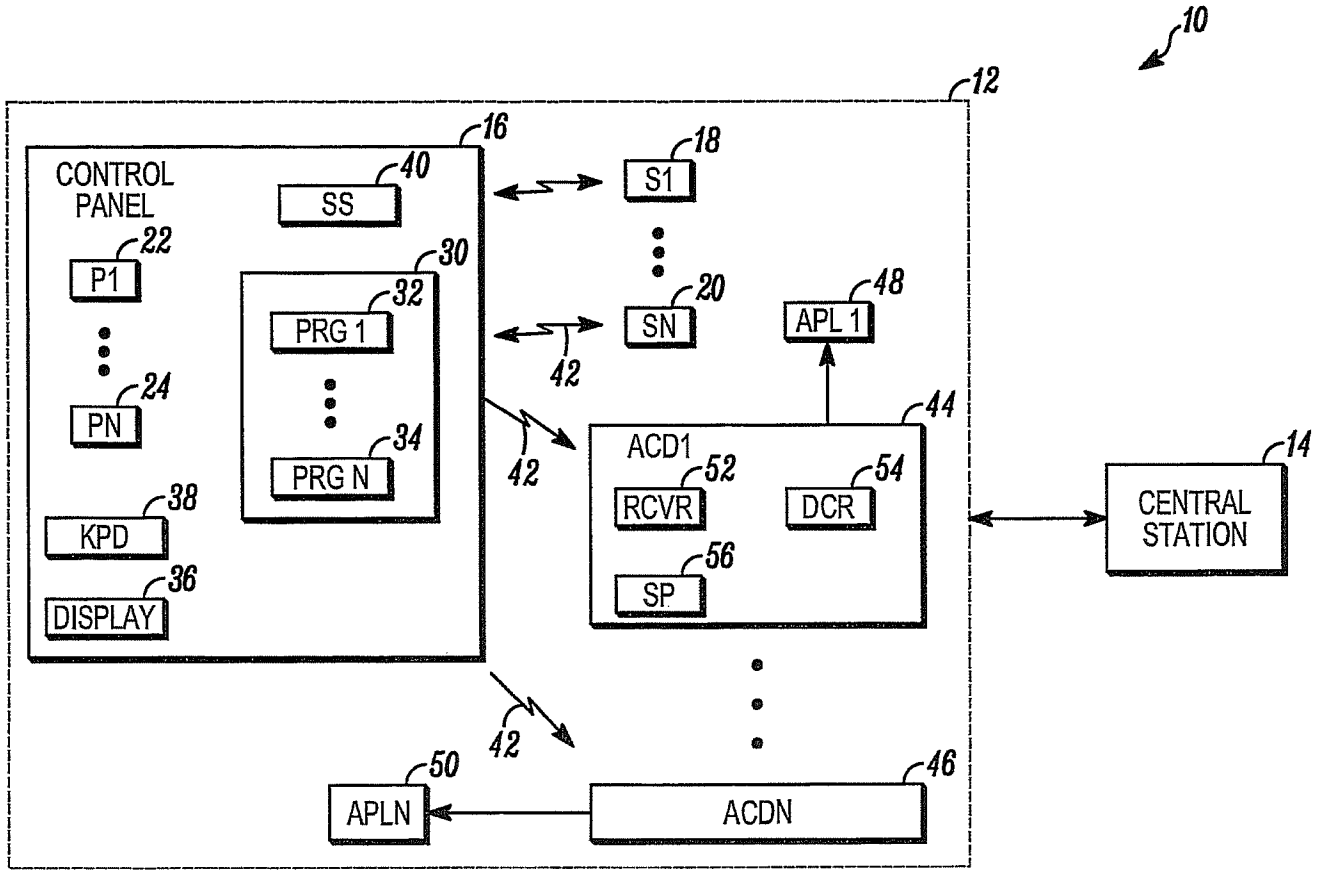
10
12
14
CENTRAL STATION
16
CONTROL PANEL
22
P1
24
PN
38
KPD
36
DISPLAY
40
SS
30
32
PRG 1
34
PRG N
18
S1
20
SN
42
42
42
44
ACD1
52
RCVR
54
DCR
56
SP
48
APL 1
46
ACDN
50
APLN

BRIDGE BETWEEN SECURITY SYSTEM AND APPLIANCES

CROSS REFERENCE TO RELATED APPLICATION

This application is a continuation of U.S. patent application Ser. No. 12/950,075 filed Nov. 19, 2010, the entirety of which is hereby incorporated by reference as if fully set forth herein.

FIELD OF THE INVENTION

The field of the invention relates to security systems and, more particularly, to wireless security systems.

BACKGROUND OF THE INVENTION

Security systems are generally known. Such systems typically include some form of physical barrier to intruders with one or more sensors to detect intruders who are able to surmount the barrier.

In the case of a home, the physical barrier may be the exterior walls of the home. In this case, the sensors may include door sensors that detect the opening or closing of the doors. Window sensors may also be provided to detect intruders who attempt to enter through a window.

The sensors within a home are typically electrical switches that are mechanically connected to a door or window. In other cases, motion detectors may be used that are based upon infrared detection or the processing of video signals.

In all cases, the sensors are connected to a control panel. The connection may be via wires or via a radio frequency signal.

The control panel typically operates in three modes including disarmed, armed, and armed stay. In the disarmed state, the control panel does not report activation of the sensors, while in the armed state the control panel sounds an alarm and may report the alarm to a central monitoring station. In the armed stay state used during night time hours, the control panel may only monitor sensors along a periphery of the home.

While security systems are effective, they are typically used in a stand-alone mode because of the need for reliability. However, homes and businesses often have a multiplicity of systems that must be adjusted or controlled based upon occupancy. Accordingly, there is a continuing need to leverage the utility of signals available within a security system for other purposes.

BRIEF DESCRIPTION OF THE DRAWING

FIG. 1 is a block diagram of an appliance control system in accordance with an illustrated embodiment of the invention.

DETAILED DESCRIPTION OF AN ILLUSTRATED EMBODIMENT

FIG. 1 is a block diagram of a security system 10 shown generally in accordance with an illustrated embodiment of the invention. The control panel 16 of the security system 10 is located within a secured area 12. Upon detection of an intruder within the secured area 12, the security system 10 is programmed to compose and send the alarm to a central station monitoring station 14. In such cases, the central monitoring station 14 sends private security personnel or notifies the local police department of the intrusion.

The panel 16 of the security system 10 includes one or more programmed processors 22, 24 operating under control of computer software (i.e., computer code). The computer code includes a number of programs 32, 34 residing in a non-transitory computer readable medium 30.

The security system 10 includes a number of intrusion sensors 18, 20 within or along a periphery of the secured area 12. The sensors 18, 20 may be electrical switches that detect the opening of a door or window or may be motion detectors that detect motion within the secured area 12. The control panel 16 may communicate with the sensors 18, 20 using wires or may communicate wirelessly.

At least one of the programmed processors 22, 24 operates as a status processor that detects entry of a code through a keyboard 38 of the security system 10 and that causes the alarm system 10 to enter a predefined state based upon the entered code. The entered code may include an alarm-away code defining an alarm-away state, a disarm code defining a disarmed state, and an alarm-stay code defining an alarm-stay state. The current state of the alarm panel 16 may be indicated by text shown on a display panel 36.

At least one other of the programmed processors 22, 24 (or one of the programs 32, 34 operating on the same processor) operates as an intrusion detection processor based upon the state of the alarm system 10. For example, the intrusion detection processor may monitor all of the sensors 18, 20 when the alarm system 10 is in the alarm-away state and only the perimeter sensors 18, 20 when the alarm system 10 is in the alarm-stay state.

Another one of the programmed processors 22, 24 (or the same processor) operates as an alarm reporting processor. In this case, whenever the intrusion detection processor detects activation of a monitored sensor 18, 20, the intrusion detection processor transfers notification thereof to the alarm reporting processor. The alarm reporting processor composes an alarm packet for transfer to the central monitoring station 14. After an entry delay, the alarm reporting processor transfers the alarm notification to the central monitoring station 14.

Upon assuming an alarm-away or alarm-stay mode, the control panel 16 may wirelessly transmit a status message 42 to the sensors 18, 20. This status message indicates a status of the alarm panel 16 and requests a status of the respective sensors 18, 20. This may be important because it is necessary to know that the area 12 is secure (i.e., the sensors 18, 20 are not in an activated state) whenever the alarm panel 16 enters the alarm-away or alarm-stay mode. If one of the sensors 18, 20 is in an activated state, then a fault message is returned to the user.

Also included within the secured area 12 are one or more appliance control devices 44, 46. The appliance control devices 44, 46 operate to control an operating level of a respective connected appliance 48, 50.

Included within each of the appliance control devices 44, 46 may be a radio frequency (rf) receiver 52, a decryption unit 54, and a status processor 56. The rf receiver 52 may continuously monitor a transmission spectrum of the security system 10 for status messages 42. Any received messages are processed within the decryption unit 54 to decrypt alarm-away, alarm-stay, and disarm messages. Any detected alarm-away and disarm messages are sent to the status processor 56.

Upon receiving an alarm-away message, the status processor 56 sends a command to any connected appliance 48, 50 to switch to a relatively low power mode. Upon receiving a disarm message, the status processor 56 sends a command to any connected appliance 48, 50 to switch to a normal mode of operation. Stated another way, the appliance control device 44, 46 has an ON and OFF output, the appliance control device 44, 46 provides one of the ON and OFF outputs upon receiving the armed status message from the security system and the other of the ON and OFF outputs upon receiving the disarmed status message.

The appliances 48, 50 may be any appropriate environmental control device within the secured area 12. For example, the appliance 48, 50 may be an air conditioner used to cool or a heating unit used to heat the area 12. Alternatively, the appliance 48, 50 may be a ceiling fan or motor operated shade or window that obstructs or opens a window to control the amount of heat or cooling that the space obtains via sunlight or the exchange of inside/outside air.

Moreover, the appliance 48, 50 may be an interface device that causes the environmental control device to operate between a relatively low power consumption mode and a relatively high power mode. An example of such an interface device is a set-back thermostat or active solar heating/cooling system.

In general, the appliance control device operates to detect the status of the alarm system 10 and, in response, to cause the appliance to switch between the relatively low power consumption mode and relatively high power mode. For example, an occupant (e.g., a homeowner) may enter an alarm-away code into his security system 10, when the occupant is about to leave the area 12 for some period of time. Entry of the alarm-away code through the keyboard 38 causes the alarm panel 16 to transmit an encrypted alarm-away message 42 to the sensors 18, 20. The message 42 causes the sensors 18, 20 to respond with an encrypted message indicating their status (e.g., activated, deactivated, etc.).

Under the claimed invention, this encrypted status message is used to control the state of the appliances 48, 50. For example, on a day where the outside temperature is 90 degrees, the receipt of the alarm-away status message 42 may cause the appliance controller 44, 46 to cause the air conditioner to switch from a set point temperature of 75 degrees to 85 degrees or higher, resulting in a substantial energy savings.

The appliance control devices 44, 46 may be provided in any of a number of different forms depending upon the format of use. For example, the appliance control device 44, 46 may be incorporated or integrated into the control system of a ceiling fan or light switch. In either case, receipt of an alarm-away message may cause the fan to become deactivated or to transcend to a very low power mode.

Alternatively, the appliance control device 44, 46 may be provided as a separate control module with a set of contacts or with a standardized bus interface (e.g., USB, PCI, etc.) or wireless interface (e.g., zigbee). In this case, the control module may be connected to an air conditioner control input to cause the air conditioner to transition to the appropriate mode.

A specific embodiment of a method and apparatus for controlling appliances in a secured area has been described for the purpose of illustrating the manner in which the invention is made and used. It should be understood that the implementation of other variations and modifications of the invention and its various aspects will be apparent to one skilled in the art and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A system comprising:

a plurality of sensing devices locatable in a selected area with at least one of the plurality of sensing devices being an intrusion sensor that detects intruders within the selected area a control panel that monitors the plurality of sensing devices, wherein, upon entering an armed state, the control panel wirelessly transmits an armed status message to the plurality of sensing devices indicating the armed state of the control panel and requesting a status of each of the plurality of sensing devices, and, upon entering a disarmed state, the control panel wirelessly transmits a disarm status message to the plurality of sensing devices indicating the disarmed state of the control panel and requesting the status of each of the plurality of sensing devices, wherein each of the plurality of sensing devices wirelessly transmits a first status message indicating activation of a respective one of the plurality of sensing devices when the respective one of the plurality of sensing devices is activated and each of the plurality of sensing devices wirelessly transmits a second status message indicating deactivation of the respective one of the plurality of sensing devices when the respective one of the plurality of sensing devices is deactivated, and wherein, upon detection of an intruder, an alarm message is sent to a central monitoring station; and a plurality of appliance control devices, each of the plurality of appliance control devices comprising:

a wireless receiver that continuously monitors a transmission, spectrum to receive the armed status message from the control panel intended for the plurality of sensing devices, the disarm status message from the control panel intended for the plurality of sensing devices, the first status message sent by the at least one of the plurality of sensing devices intended for the control panel, and the second status messages sent by the at least one of the plurality of sensing devices intended. for the control panel;

a decryption device that decrypts the received armed status message, the received disarm status message, the received first status message, and the received second status message; and a status processor that provides ON and OFF outputs to a connected appliance based on the received armed status message, the received disarm status message, the received first status message, and the received second status message, wherein each of the plurality of appliance control devices provides a first of the ON and. OFF outputs upon receiving the second status message and the armed status message, wherein each of the plurality of appliance control devices provides a second of the ON and OFF outputs upon receiving the disarm status message from the control panel, and wherein each of the plurality of appliance control devices provides neither of the ON and OFF outputs upon receiving the first status message and the armed status message.

2. The system as in claim I further comprising the at least one of the plurality of sensing devices wirelessly transmitting the first status message indicating activation of the at least one of the plurality of sensing devices when the at least one of the plurality of sensing devices is activated in response to the control panel transmitting the armed status message.

3. The system as in claim 1 further comprising the at least one of the plurality of sensing devices wirelessly transmitting the second status message indicating deactivation of the at least one of the plurality of sensing devices when the at least one of the plurality of sensing devices is deactivated in response to the control panel transmitting the disarm status message.

4. The system as in claim 1 further comprising the connected appliance activated by one of the plurality of appliance control devices.

5. The system as in claim 4 wherein the connected appliance further comprises a heating unit.

6. The system as in claim 1 wherein at least some of the plurality of appliance control devices include a thermostat.

7. The system as in claim 6 wherein the thermostat is coupled to at least one of a fan, a lighting control unit, a heating unit, or an air conditioning unit.

8. A system comprising:

at least one sensing device locatable within a selected area that detects intruders within the selected area;

a control panel that monitors the at least one sensing device and notifies a central monitoring station of an intrusion, wherein, upon entering an armed state, the control panel wirelessly transmits an armed status message to the at least one sensing device indicating the armed state of the control panel and requesting a status of the at least one sensing device, and, upon entering a disarmed state, the control panel wirelessly transmits a disarm status message to the at least one sensing device indicating the disarmed state of the control panel and requesting the status of the at least one sensing device;

a wireless transmitter of the at least one sensing device that wirelessly transmits a first status message associated with activation of the at least one sensing device and a second status message associated with deactivation of the at least one sensing device, wherein the at least one sensing device transmits either the first status message or the second status message to the control panel in response to the armed status message or the disarm status message transmitted by the control panel requesting the status of the at least one sensing device; and an appliance control device having a wireless receiver, a first output, and a second output, wherein the appliance control device continuously monitors a transmission spectrum to receive the armed status message from the control panel intended for the at least one sensing device, the disarm status message from the control panel intended for the at least one sensing device, the first status message sent by the at least one sensing device intended for the control panel, and the second status messages sent by the at least one sensing device intended for the control panel, wherein the appliance control device provides the first output upon receiving the armed status message from the control panel and the second status message and provides the second output upon receiving the disarm status message from the control panel, and wherein the appliance control device provides neither of the first output or the second output upon receiving the first status message and the armed status message.

9. The system as in claim 8 wherein the appliance control device further comprises a thermostat controlling a temperature of the selected area.

10. The system as in claim 9 further comprising an appliance activated by the appliance control device.

11. The system as in claim 10 wherein the appliance further comprises at least one of a heater, an air conditioner, or a fan.

12. A method comprising:

providing a control panel and a plurality of sensing devices within a selected area;

upon entering an armed state, the control panel wirelessly transmitting an armed status message to the plurality of sensing devices indicating the armed state of the control panel and requesting a status of each of the plurality of sensing devices;

upon entering a disarmed state, the control panel wirelessly transmitting a disarm status message to the plurality of sensing devices indicating the disarmed state of the control panel and requesting the status of each of the plurality of sensing devices;

the plurality of sensing devices transmitting status messages including at least a first status message indicating that one of the plurality of sensing devices is activated and a second status message indicating that the one of the plurality of sensing devices is deactivated, the plurality of sensing devices including at least one intrusion sensor that, upon detecting an intruder within the selected area, notifies a central monitoring station of an intrusion;

providing an appliance control device that continuously monitors a selected transmission spectrum to receive the armed status message from the control panel intended for the plurality of sensing devices, the disarm status message from the control panel intended for the plurality of sensing devices, the first status message sent by the plurality of sensing devices intended for the control panel, and the second status messages sent by the plurality of sensing devices intended thr the control panel; and providing an appliance associated with the selected area and controlled by the appliance control device, the appliance entering a low energy consuming mode in response to the appliance control device receiving the armed status message from the control panel and the second status message, and the appliance entering a high energy consuming mode in response to the appliance control device receiving the disarm status message from the control panel, wherein, when the appliance is in the high energy consuming mode, the appliance does not switch to the low energy consuming mode in response to the appliance control device receiving the armed message from the control panel and the first status message.

13. The method as in claim 12 wherein the appliance control device comprises a thermostat.

14. The method as in claim 12 wherein the appliance comprises at least one of a heating unit, a fan, or a cooling unit.

* * * * *